US005884130A

United States Patent [19]

Tsutsumi et al.

[11] Patent Number: 5,884,130

[45] Date of Patent: Mar. 16, 1999

[54] DEVELOPING DEVICE WITH SUPPORT STRUCTURE FOR CONVEYING MEANS

[75] Inventors: Yasuyuki Tsutsumi; Toru Isosu; Hideaki Sakata, all of Iwatsuki, Japan

[73] Assignee: Fuji Xerox Co., Ltd., Tokyo, Japan

[21] Appl. No.: 949,782

[22] Filed: Oct. 14, 1997

[30] Foreign Application Priority Data

Oct. 14, 1996 [JP] Japan ..... 8-270872

[51] Int. Cl.[6] ..... G03G 15/04

[52] U.S. Cl. ..... 399/254; 366/312; 366/331; 399/258

[58] Field of Search ..... 399/254, 255, 399/263, 258; 366/309, 312, 313, 331

[56] References Cited

U.S. PATENT DOCUMENTS 5,134,441 7/1992 Nagata et al. ..... 399/103

FOREIGN PATENT DOCUMENTS 3-142489 6/1991 Japan .
3-149579 6/1991 Japan .
4-191768 7/1992 Japan .
4-204466 7/1992 Japan .
4-323678 11/1992 Japan .
6-282165 10/1994 Japan .

*Primary Examiner*—Joan Pendegrass
*Attorney, Agent, or Firm*—Finnegan, Henderson, Farabow, Garrett & Dunner, L.L.P.

[57] ABSTRACT

A developing device which can withstand resistance at a time a coagulated toner is scraped off is provided merely by providing a rotating shaft with a strength needed for agitating and conveying toner during normal operation. When the coagulated toner is scraped off, a large load is applied to the rotating shaft through an agitator. The rotating shaft bends, and a crank portion of the rotating shaft moves off of an axis. As a result, the crank portion is supported in a cut portion in a support plate. Therefore, strength of the rotating shaft becomes apparently greater. During normal operation, the crank portion of the rotating shaft moves out of the cut portion so as to be set in a state of non-contact with the cut portion. Therefore, no unnecessary load is applied to the rotating shaft, and the crank portion and the cut portion are not worn.

25 Claims, 13 Drawing Sheets

DEVELOPING DEVICE WITH SUPPORT STRUCTURE FOR CONVEYING MEANS

BACKGROUND OF THE INVENTION

1. Field of the Invention

The present invention relates to a developing device in the field of electrophotographic image forming apparatuses.

2. Description of the Prior Art

A developing device accommodating a toner therein is mounted detachably to an electrophotographic image forming apparatus. Images are formed by setting a developing roll provided at the developing device in opposition to a photosensitive drum, feeding the toner accommodated in a toner tank to the developing roll while agitating and conveying the toner by an agitator, and making an electrostatic latent image formed on the photosensitive drum visible by the toner.

If left to stand for a while, the toner accommodated in the toner tank coagulates. Therefore, the initial resistance at the time the toner is scraped off from the mass of toner, which has coagulated in the toner tank, and is agitated by the agitator is large.

Here, in order to minimize the resistance at the initial stages of agitation of the toner, there are proposed structures such as using an elastic member for the agitator (Japanese Patent Applications Laid-Open (JP-A) Nos. 3-149579, 4-191768), and changing by 180 degrees the projecting direction of the agitator mounted on a rotating shaft, at a central portion and the both end portions of the rotating shaft (JP-A-4-204466).

However, in either of these developing devices, the rotating shaft must have a strength sufficient to endure the resistance when the coagulated toner is scraped off. Consequently, the rotating shaft must be provided with a strength greater than or equal to the strength necessary for agitating and feeding the toner at the time of normal operation. Thus, the device becomes large and the manufacturing cost thereof rises.

SUMMARY OF THE INVENTION

In view of the aforementioned, an object of the present invention is to provide a developing device which, with a simple structure, can withstand resistance at the time of scraping off coagulated toner, simply by providing a rotating shaft with the strength necessary for agitating and feeding the toner at the time of normal operation.

In the present invention, a conveying means is provided within a toner tank which accommodates toner. The conveying means agitates the toner and conveys the toner to a developing roll through an opening portion formed in the toner tank.

The toner tank is provided with a support means. When resistance is applied at the time when the coagulated toner is being scraped off by the conveying means, the conveying means is supported by a support means such that the amount of bending is limited to a given range and the apparent strength increases. Due to this simple structure, the conveying means can be designed so as to have the strength needed for agitating and conveying the toner at the time of normal operation, thus allowing the developing device to be made compact.

Further, during normal operation when no large load is applied to the conveying means, the support means may be set in a state of non-contact. In this way, the conveying means and the support means are not worn down by sliding against each other, and therefore, the toner does not deteriorate due to heat caused by friction, pressure applied when toner is caught between portions of the conveying means and the support means which slide against each other, powder formed by abrasion of respective members, or the like.

The conveying means and the support means may contact each other provided that such contact does not hinder the rotation of the conveying means.

DETAILED DESCRIPTION OF THE PREFERRED EMBODIMENTS

Figure 1:
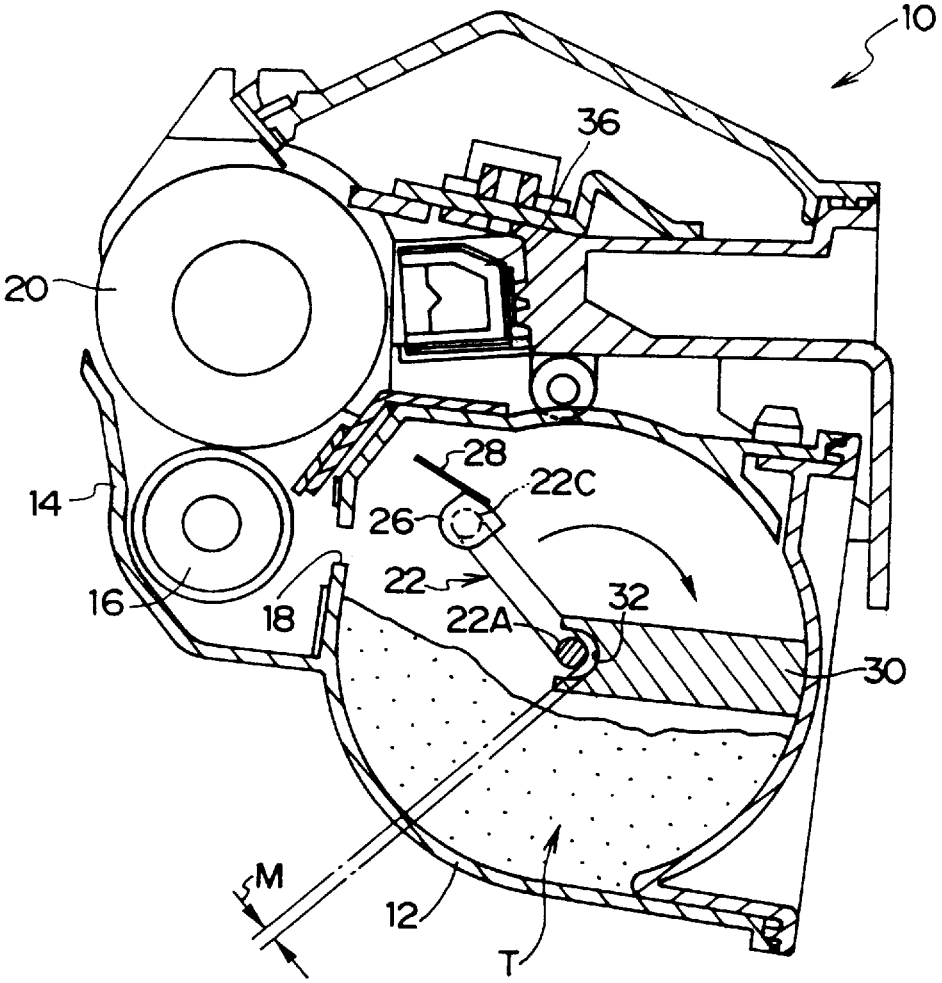
FIG. 1 is a sectional view showing a developing device relating to a first embodiment of the present invention at the time of normal operation.

As shown in FIG. 1 to FIG. 4, a developing device 10 relating to the first embodiment is equipped with a tubular toner tank 12. A substantially parallelepiped case 14 whose upper side is open projects from the toner tank 12. A developing roll 16 is rotatably supported at a side wall of the case 14, and is rotated by a gear mechanism (not illustrated) provided at a shaft portion. Further, an opening 18 is formed at the toner tank 12 at a position opposing the developing roll 16. Toner T accommodated in the toner tank 12 is fed to the case 14 through the opening 18.

The toner T fed to the case 14 is attracted by the magnetic force of the developing roll 16 so as to form a thin layer on the surface of the developing roll 16. This thin layer of the toner T is supplied to a photosensitive drum 20 so as to develop an electrostatic latent image on the photosensitive drum 20.

A rotating shaft 22 is provided within the toner tank 12 along the longitudinal direction thereof. Crank portions 22A, 22B which are bent are formed at the rotating shaft 22 at a central portion and at the end portions thereof. Further, straight portions 22C are formed at the rotating shaft 22 so as to be spaced apart from an axis L of bearings 24 of the toner tank 12 and so as to extend parallel to the axis L. Agitators 26 are fixed to the straight portions 22C, and the crank portions 22B are supported at the bearings 24.

A fin-shaped member 28 formed of an elastic resin material, for example MYLAR is provided at the distal end portion of the agitator 26 so as to extend along the longitudinal direction of the agitator 26. When a load is applied at the time of agitating the toner T, the fin-shaped members 28 deform elastically to reduce the radius of gyration, decrease the load acting on the rotating shaft 22, slide gently along the inner wall of the toner tank 12, and thus reliably convey the toner T.

Further, a rectangular support plate 30 projects toward the axis L from a central portion of the inner wall of the toner tank 12. A semicircular cut 32 is formed at a free end portion of the support plate 30, and the crank portion 22A of the rotating shaft 22 enters into the cut 32 in a non-contact state, and is rotatable within the cut 32.

Next, operation of the developing device relating to the first embodiment will be described.

When the developing device 10 is incorporated in an electrophotographic image forming apparatus and a power source is turned on, the rotating shaft 22 and the agitator 26 rotate integrally. Usually, the developing device 10 is left stationary until it is incorporated in the electrophotographic image forming apparatus, and therefore, the toner T accommodated in the toner tank 12 is coagulated.

Figure 2:
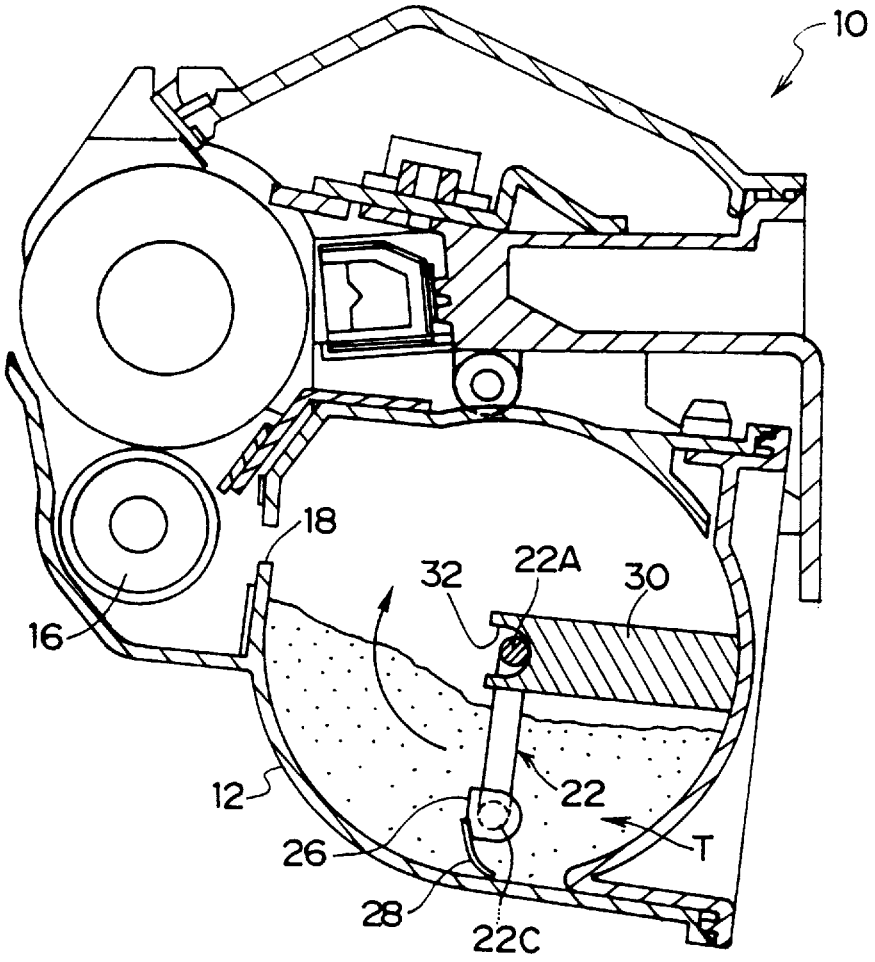
FIG. 2 is a sectional view showing a state in which a rotating shaft of the developing device relating to the first embodiment is bent.
Figure 3:
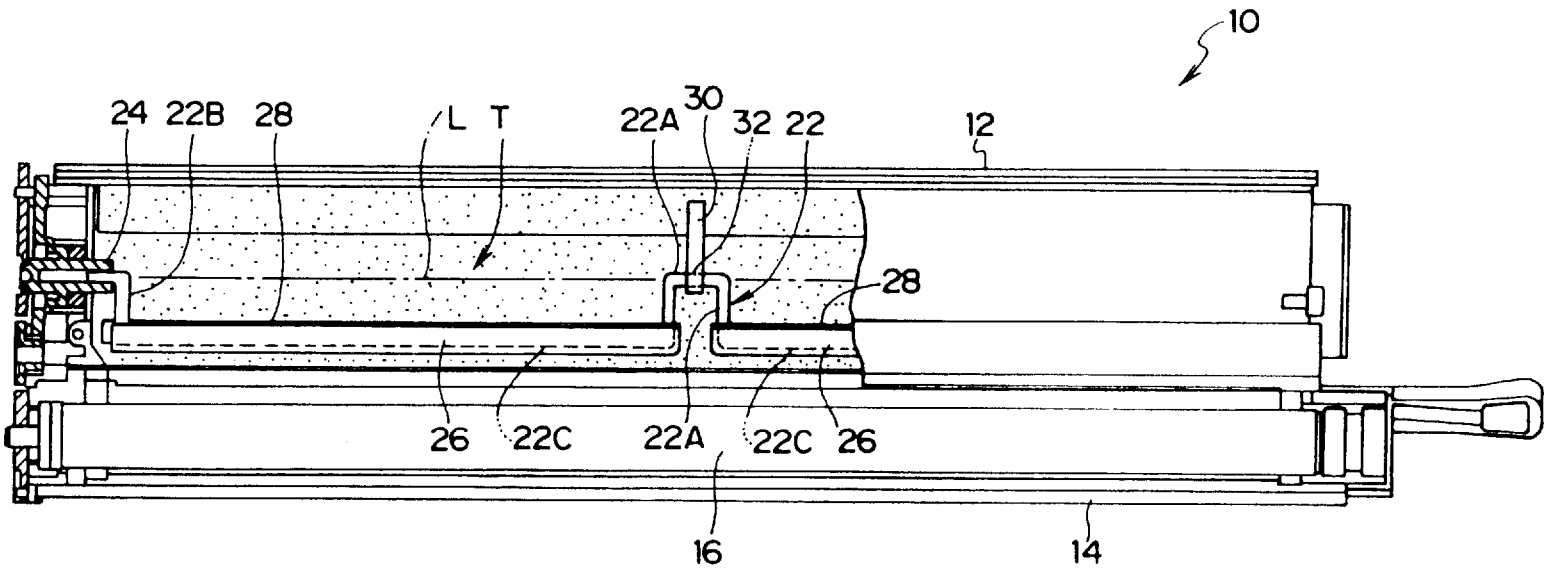
FIG. 3 is a plan view of the developing device relating to the first embodiment.
Figure 4:
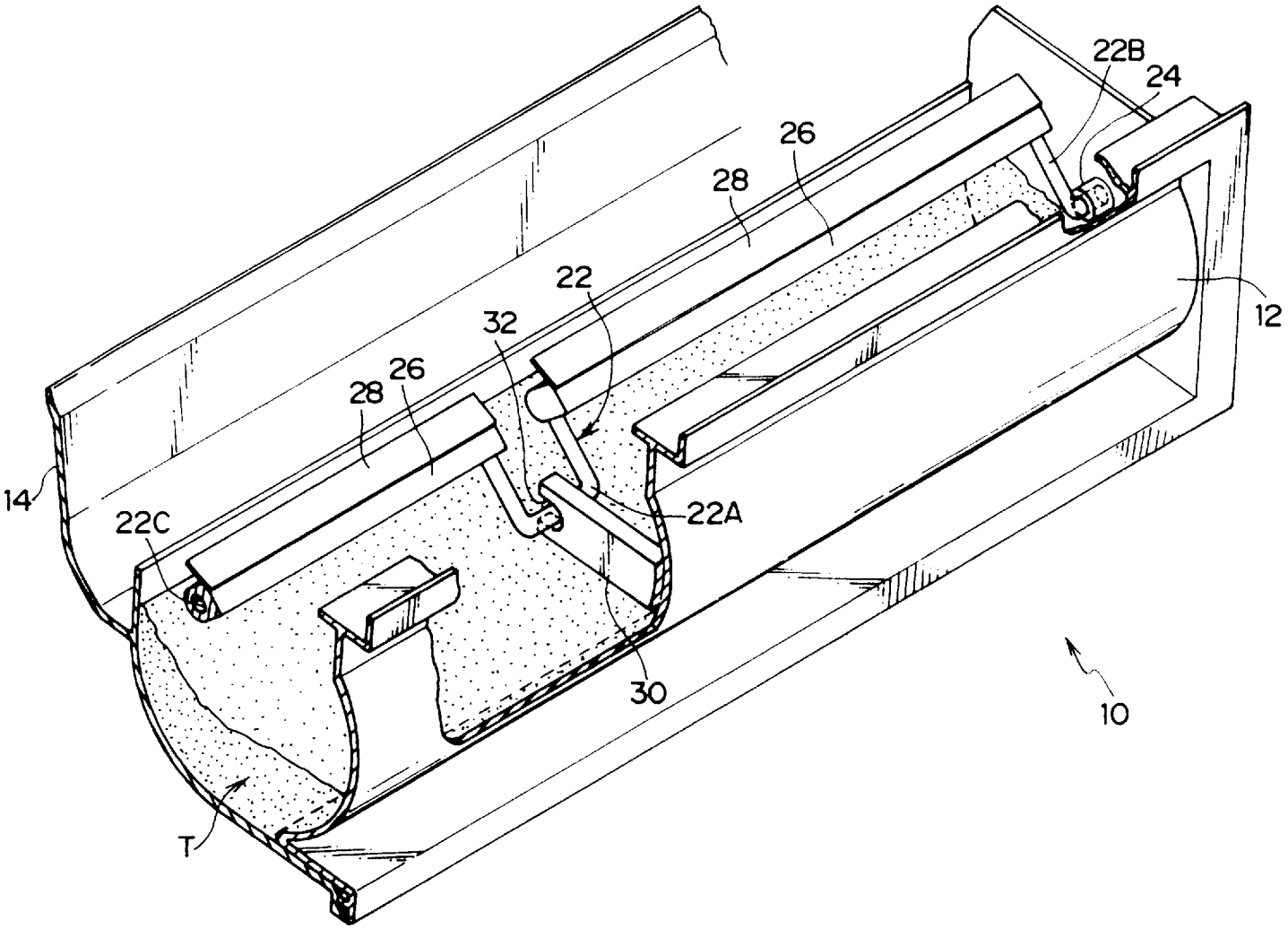
FIG. 4 is a perspective view of the developing device relating to the first embodiment.

Consequently, a large load acts on the rotating shaft 22 through the agitator 26 when the coagulated toner T is scraped off. When the rotating shaft 22 bends, the crank portion 22A thereof is supported in the cut 32 of the support plate 30 as shown in FIG. 2. Therefore, the load acting on the rotating shaft 22 is supported at three points which are the bearings 24 and the cut 32.

As a result, the strength of the rotating shaft 22 is apparently increased. Therefore, there is no need to provide excessive strength to scrape off the coagulated toner T as in a conventional structure in which the rotating shaft 24 merely spans between the bearings 24. The structure is simple, and therefore, the manufacturing costs can be reduced.

The size of a clearance M (see FIG. 1) formed between the cut 32 and the crank portion 22A when the crank portion 22A is positioned on the axis L must be set such that the rotating shaft 22 does not plastically deform even when bent.

Next, when the coagulated toner T is scraped off and then agitated and conveyed by the agitator 26, the load acting on the rotating shaft 22 through the agitator 26 is decreased. At the time of such normal operation, the crank portion 22A of the rotating shaft 22 leaves the cut 32 so as to be in a state of non-contact with the cut 32. Therefore, no unnecessary load is applied to the rotating shaft 22. Further, since the crank portion 22A and the cut 32 are not worn, the toner does not deteriorate due to heat caused by friction, pressure applied when toner is caught between portions sliding against each other, powder formed by abrasion of members, or the like.

Thus, the toner T agitated and conveyed by the agitator 26 is supplied to the case 14 by way of the opening 18. Here, the toner is supplied by the developing roll 16 to the photosensitive drum 20 having an electrostatic latent image formed thereon by being charged by a charger 36 and exposed by laser beam functioning as a write element. The electrostatic latent image is developed by the toner.

Figure 11:
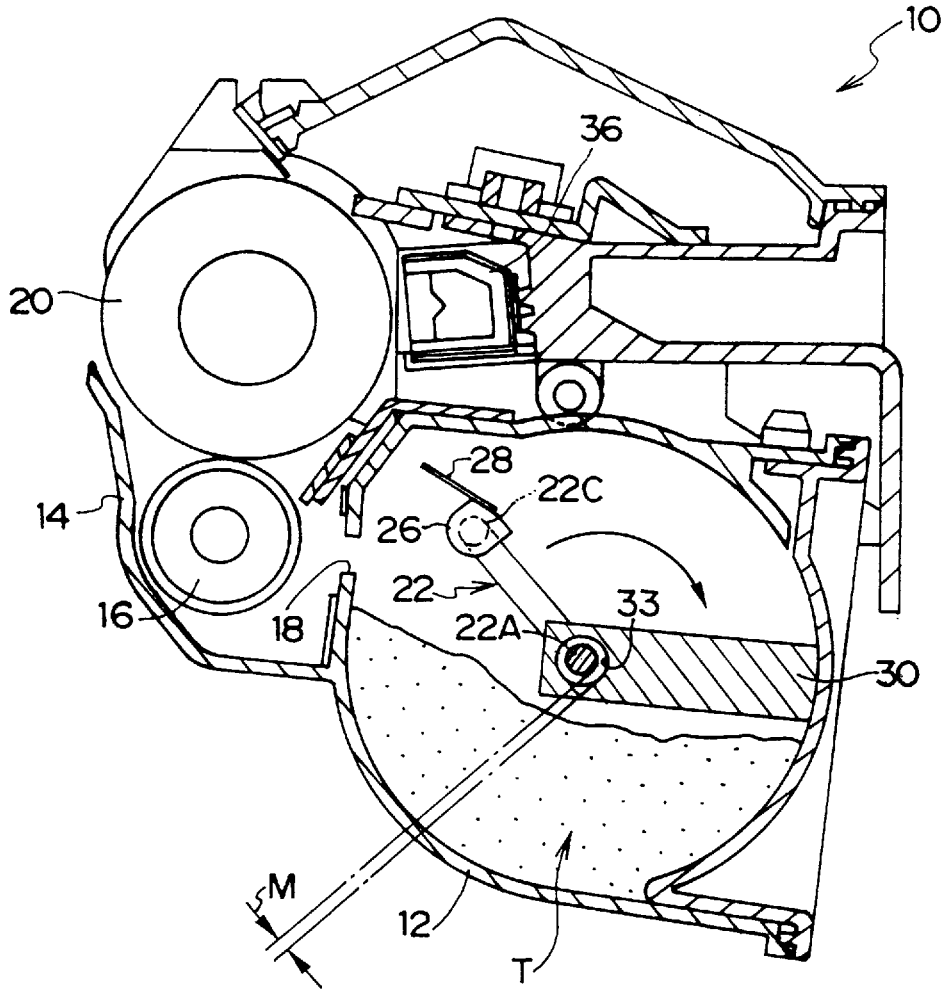
FIG. 11 is sectional view showing a developing device relating to a modified example of the first embodiment at the time of normal operation.

In the present first embodiment, the cut 32 is provided in the support plate 30. However, as illustrated in FIG. 11, a circular hole 33 in which the crank portion 22A is positioned in a non-contact state may be used.

Next, a developing device 38 relating to a second embodiment will be described.

Figure 5:
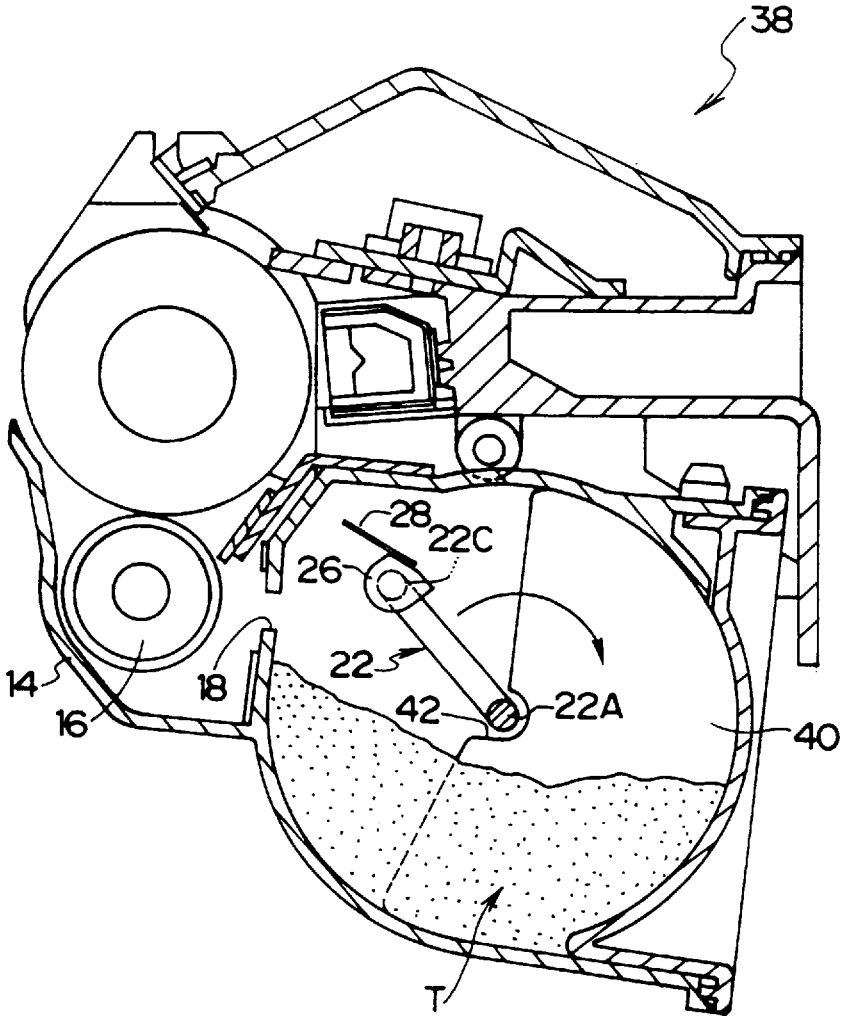
FIG. 5 is a sectional view showing a developing device relating to a second embodiment of the present invention at the time of normal operation.
Figure 6:
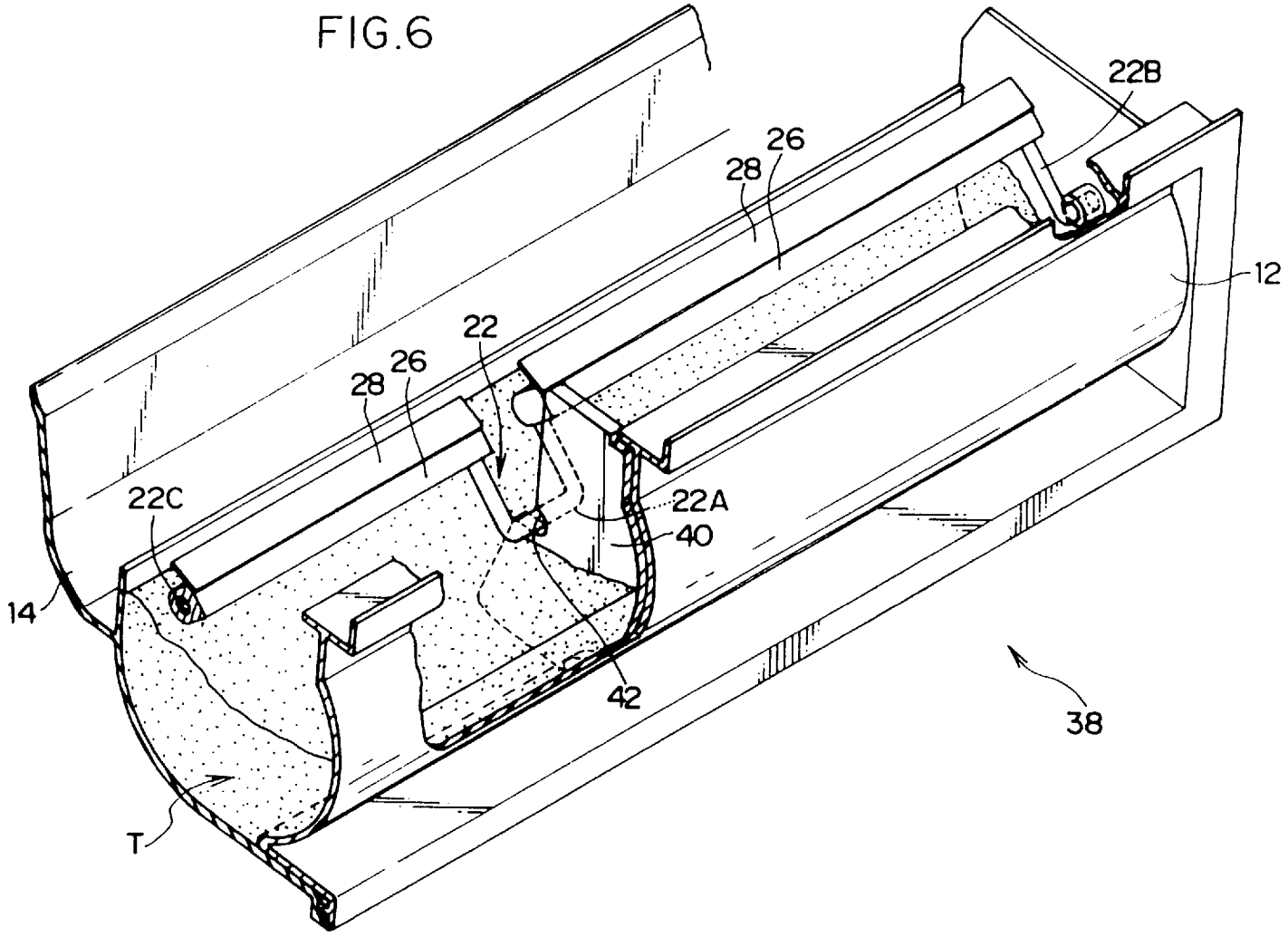
FIG. 6 is a perspective view of the developing device relating to the second embodiment.

As shown in FIG. 5 and FIG. 6, in the second embodiment, a support plate 40 having a size of substantially half of the transverse cross-sectional area of the toner tank 12 projects onto the axis of the rotating shaft 22 from the inner wall of the toner tank 12 at the side opposite the opening 18. A semicircular cut 42 is formed at a position where the support plate 40 faces the crank portion 22A. The crank portion 22A enters into the semicircular cut 42 in a non-contact state, and is rotatable within the cut 42.

In the same way as in the first embodiment, the crank portion 22A is supported in the cut 42 when the agitator 26 scrapes off the coagulated toner T. The strength of the rotating shaft 22 is apparently increased, and therefore, there is no need to provide the rotating shaft 22 with excessive strength.

Further, since the support plate 40 serves as apartition wall so as to partition the toner tank 12 in the longitudinal direction, offset of the toner, which is accommodated in the toner tank 12, toward one side during the transporting of the developing device 38 is prevented.

Next, a developing device relating to a third embodiment will be described.

Figure 7:
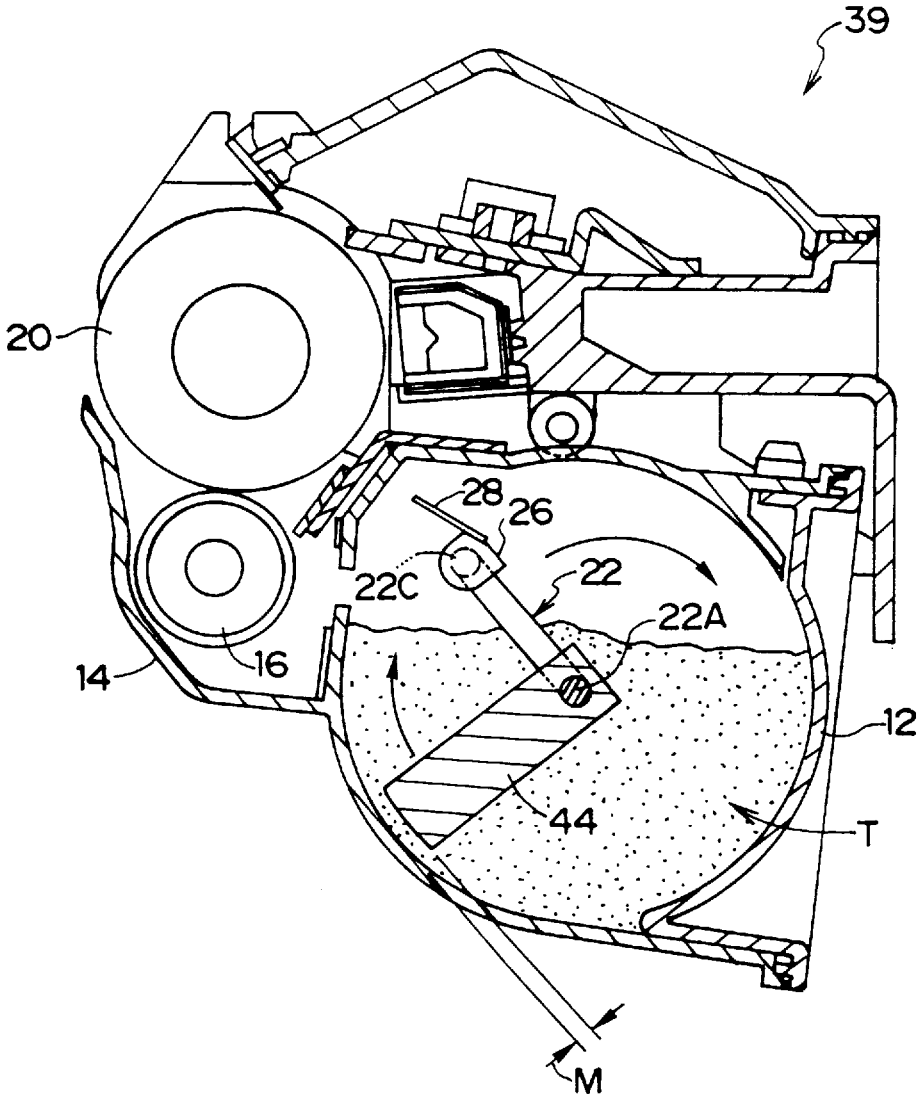
FIG. 7 is a sectional view showing a developing device relating to a third embodiment of the present invention at the time of normal operation.
Figure 8:
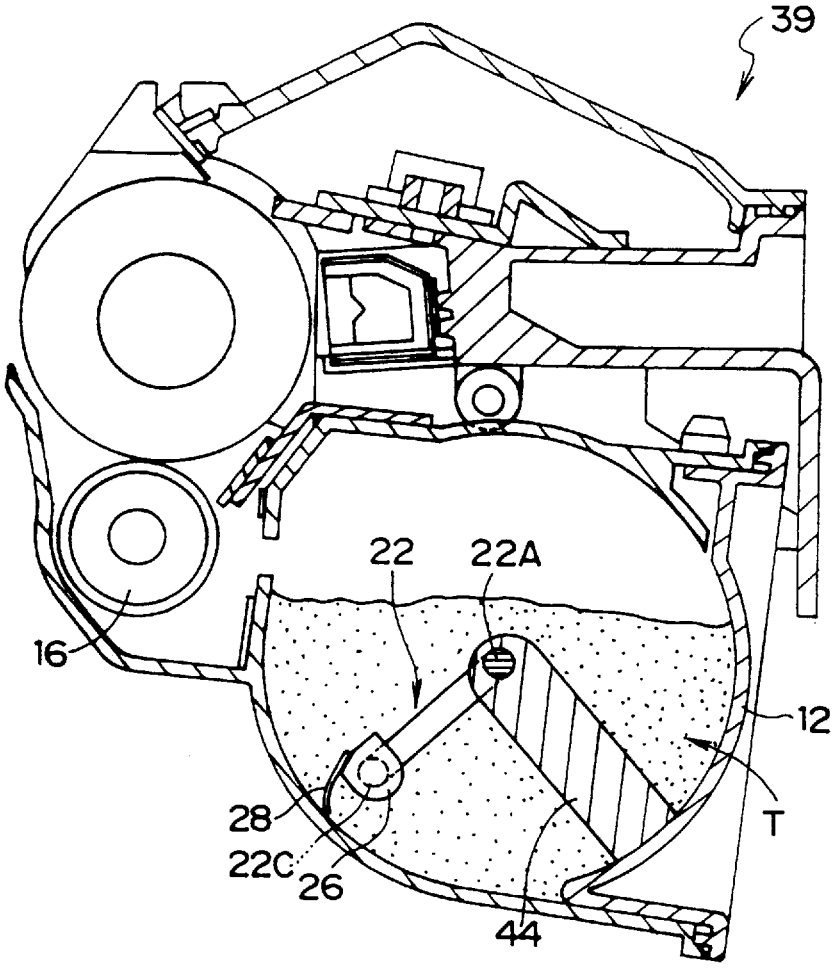
FIG. 8 is a sectional view showing a state in which a rotating shaft of the developing device relating to the third embodiment is bent.
Figure 9:
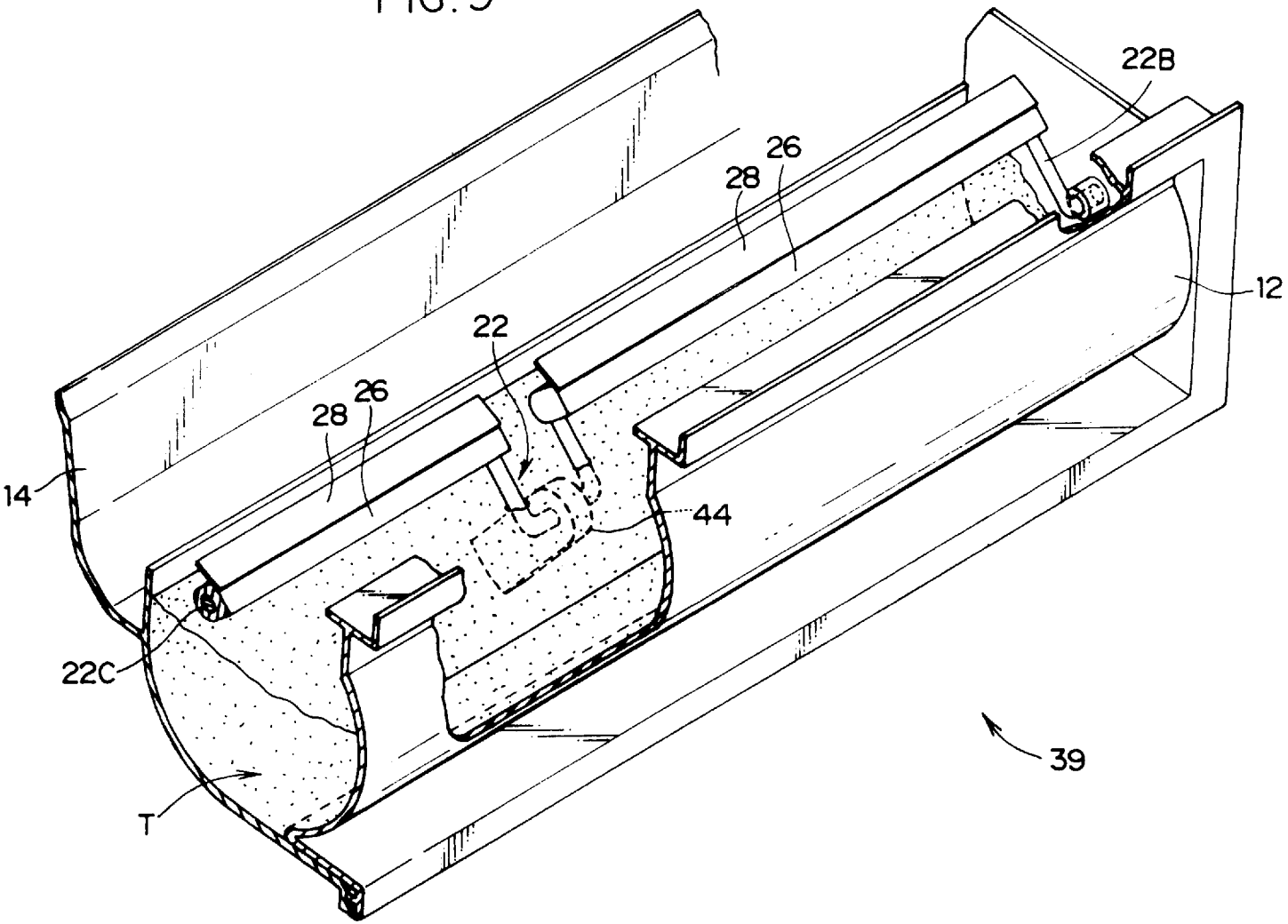
FIG. 9 is a perspective view of the developing device relating to the third embodiment.

As shown in FIG. 7 to FIG. 9, in a developing device 39 of the third embodiment, a support member 44 is fixed to the crank portion 22A of the rotating shaft 22, and projects out in a direction orthogonal to the agitator 26. The support member 44 rotates integrally with the rotating shaft 22. The length of the support member 44 is set such that there is a predetermined clearance M (see FIG. 7) between the distal end portion of the support plate 44 and the inner wall of the toner tank 12.

Next, operation of the developing device relating to the present third embodiment will be described.

When a large load acts on the rotating shaft 22 through the agitator 26 at the time of scraping off the coagulated toner T, the crank portion 22A formed at the central portion of the rotating shaft 22 comes off of the axis. Thus, as shown in FIG. 8, the distal end of the support member 44 comes in contact with the inner wall of the toner tank 12 to support the central portion of the rotating shaft 22.

As a result, the strength of the rotating shaft 22 is apparently increased, and it is not necessary to provide the rotating shaft 22 with an excessive strength. Further, when the coagulated toner T is scraped off and the toner T is then agitated and conveyed by the agitator 26, the load acting on the rotating shaft 22 through the agitator 26 decreases. At the time of such normal operation, since the distal end of the support member 44 separates from the inner wall of the toner tank 12, no unnecessary load is applied to the rotating shaft 22, and the support member 44 and the toner tank 12 are not worn. Therefore, the toner T does not deteriorate due to heat caused by friction, pressure applied when toner is caught between portions sliding against each other, powder formed by abrasion of members, or the like.

Figure 10:
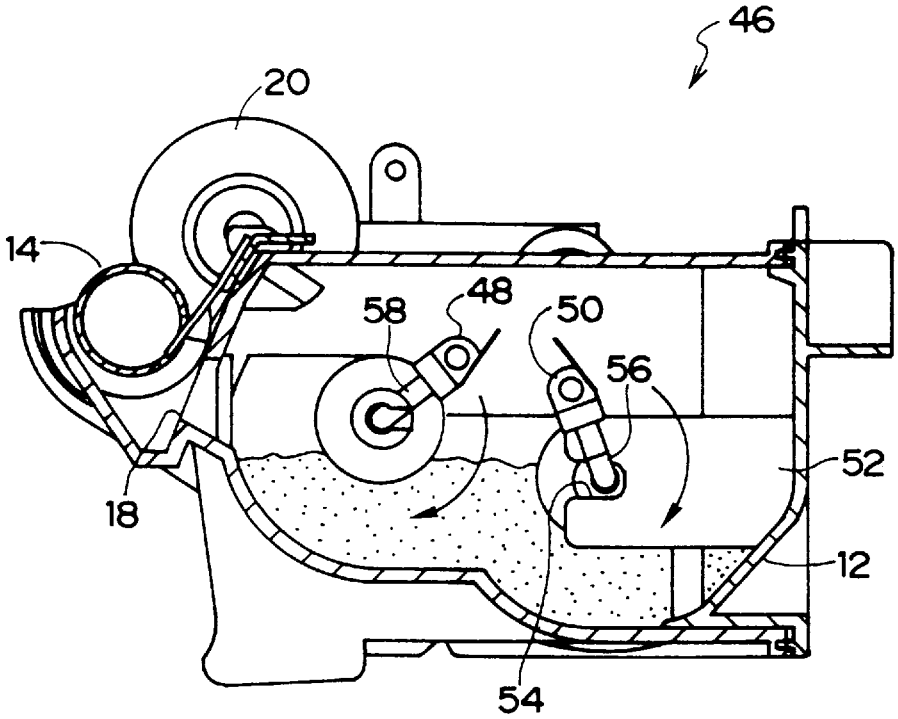
FIG. 10 is a sectional view showing a developing device provided with two agitators.

As shown in FIG. 10, the present invention is applicable also to a developing device 46 having plural agitators 48, 50 disposed in the toner tank 12. In this case, at the time of scraping off the toner T, a large resistance is generated at the agitator 50 which is disposed at the side oppose the direction in which the toner T is being carried (i.e., at the side far from the opening 18). Consequently, a support plate 52 with a cut 54 formed therein is disposed so as to support a rotating shaft 56 of the agitator 50. A support plate for supporting a rotating shaft 58 of the agitator 48 may of course also be provided within the toner tank 12.

Figure 12:
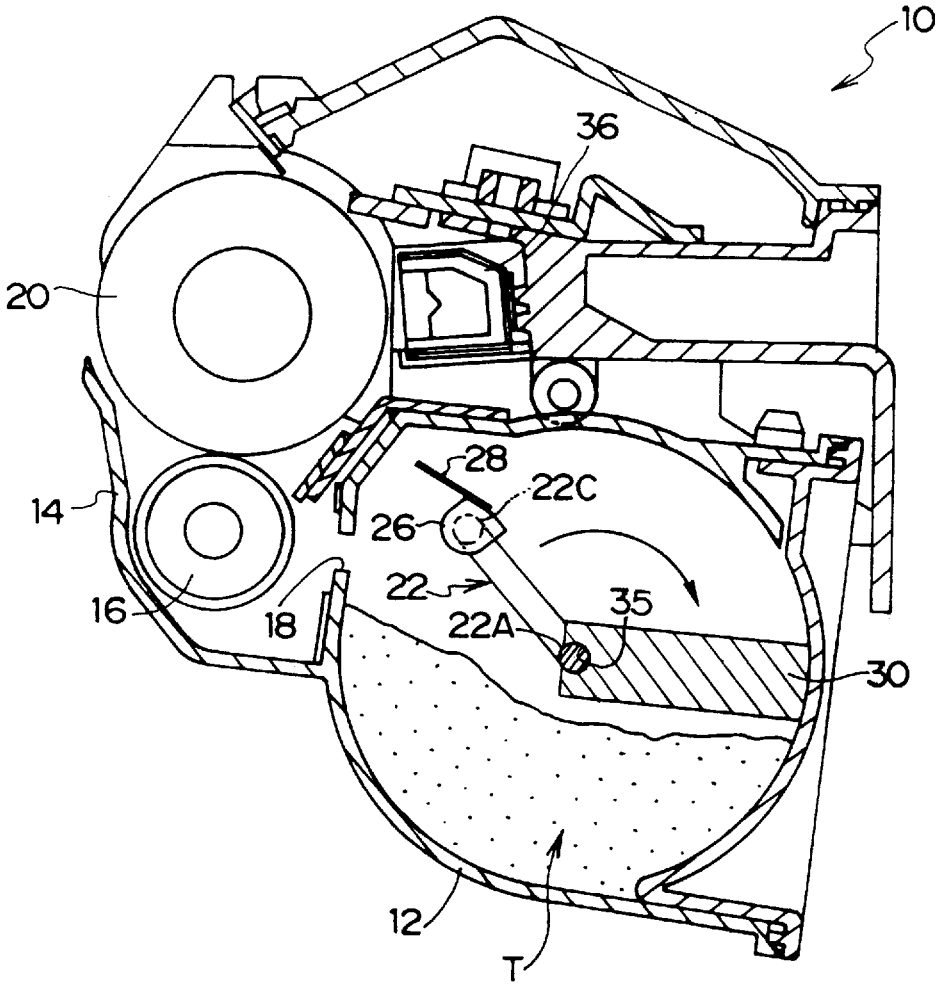
FIG. 12 is a sectional view showing a developing device relating to another modified example of the first embodiment at the time of normal operation.
Figure 13:
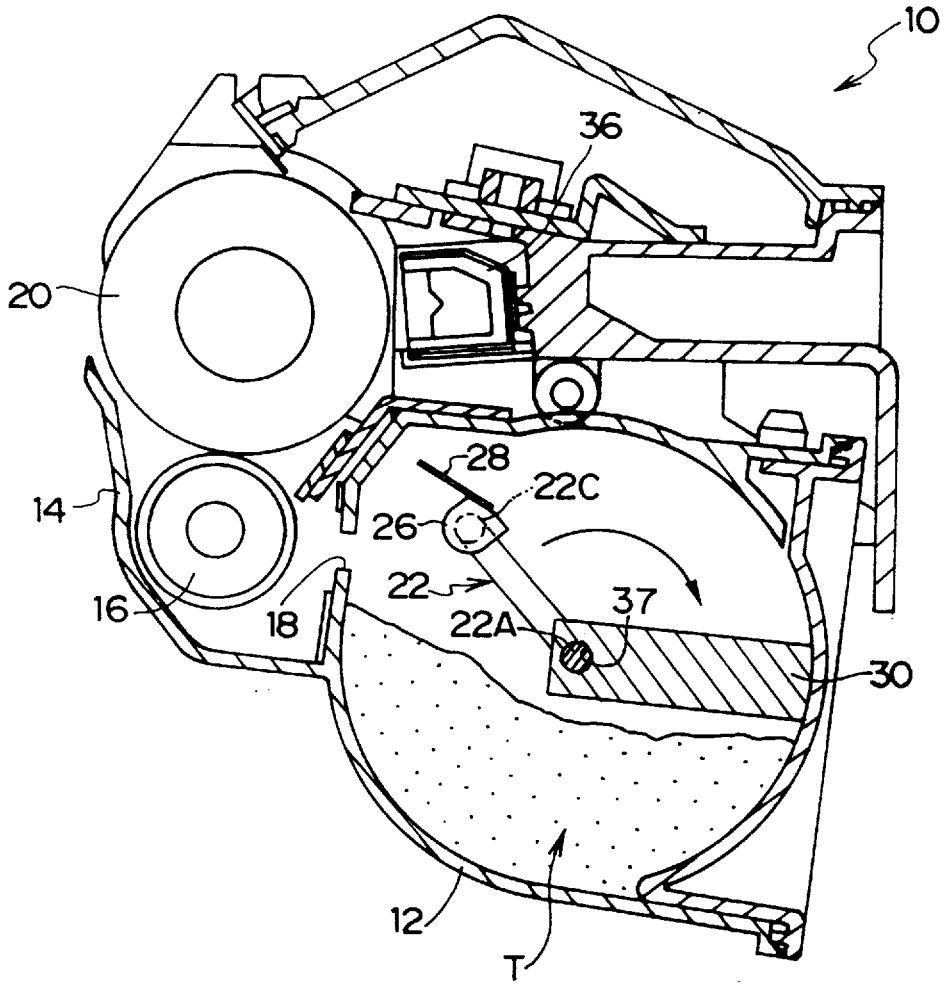
FIG. 13 is a sectional view showing a developing device relating to yet another modified example of the first embodiment at the time of normal operation.

As illustrated in FIGS. 12 and 13, the sizes of a cut 35 and a circular hole 37 may be determined such that the cut 35 and the circular hole 37 contact the crank portion 22A, provided that the crank portion 22A of the rotating shaft 22 is not subjected to resistance at the time of rotation.

Due to the above-described structure, in the present invention, the resistance at the time of scraping off coagulated toner can be withstood with a simple structure, merely by providing the rotating shaft with the strength necessary for agitating and conveying the toner at the time of normal operation. Further, the toner is not offset toward one side within the toner tank.

What is claimed is:

1. A developing device having a toner tank for accommodating a toner and conveying means disposed within the toner tank for agitating the toner and conveying the toner to a developing roll through an opening portion formed in the toner tank, the conveying means having a shaft rotatably disposed in the tank and a conveying member mounted on the shaft, the developing device comprising:

support means, provided within the toner tank for supporting the shaft when the conveying means bends to limit bending of the conveying means to a given range.

2. A developing device according to claim 1, wherein the support means supports a longitudinal direction central portion of the conveying means.

3. A developing device having a toner tank which accommodates a toner, and conveying means which is disposed within the toner tank, agitates and conveys the toner, and conveys the toner to a developing roll through an opening portion formed in the toner tank the developing device comprising:

support means, provided within the toner tank, for, when the conveying means bends, supporting the conveying means and limiting bending of the conveying means to a given range;

wherein the support means partitions the toner tank in a longitudinal direction of the toner tank, so as to prevent the toner accommodated within the toner tank from being offset toward one side at a time of transport of the developing device.

4. A developing device having a toner tank which accommodates a toner, and conveying means which is disposed within the toner tank, agitates and conveys the toner, and conveys the toner to a developing roll through an opening portion formed in the toner tank the developing device comprising:

support means, provided within the toner tank, for, when the conveying means bends, supporting the conveying means and limiting bending of the conveying means to a given range;

wherein the conveying means is formed by a rotatable shaft disposed rotatably along a longitudinal direction of the toner tank, and a conveying member mounted to the rotatable shaft and agitating and conveying the toner, and the support means is formed by a support plate provided within the toner tank in a state of non-contact with the rotatable shaft and supporting the rotatable shaft when the rotatable shaft bends.

5. A developing device according to claim 4, wherein a holding portion is formed at the support plate, the holding portion holding a portion of the rotatable shaft in a state of non-contact such that the portion of the rotatable shaft is rotatable.

6. A developing device according to claim 5, wherein the holding portion is a cut portion which is open toward the opening portion formed in the toner tank.

7. A developing device according to claim 5, wherein the holding portion is a circular hole which is formed in the support plate and through which the rotatable shaft passes.

8. A developing device according to claim 4, wherein the support plate supports a crank portion formed at a central portion of the rotatable shaft.

9. A developing device according to claim 4, wherein an elastically-deformable fin is provided at a distal end of the conveying member.

10. A developing device having a toner tank which accommodates a toner, and conveying means which is disposed within the toner tank, agitates and conveys the toner, and conveys the toner to a developing roll through an opening portion formed in the toner tank the developing device comprising:

support means, provided within the toner tank, for, when the conveying means bends, supporting the conveying means and limiting bending of the conveying means to a given range;

wherein the conveying means is formed by a rotatable shaft disposed rotatably along a longitudinal direction of the toner tank, and a conveying member mounted to the rotatable shaft and agitating and conveying the toner, and the support means is formed by a support member mounted to the rotatable shaft and rotating integrally with the rotatable shaft with a predetermined clearance between the support member and an inner wall of the toner tank.

11. A developing device according to claim 10, wherein the support member projects in a direction orthogonal to the conveying member.

12. A developing device having a toner tank for accommodating a toner and conveying means having a shaft rotatably disposed within the toner tank for agitating the toner and conveying the toner to a developing roll through an opening portion formed in the toner tank, the developing device comprising:

support means, provided within the toner tank, for contacting the shaft when load is applied to the conveying means by the toner.

13. A developing device according to claim 12, wherein the support means supports a longitudinal direction central portion of the conveying means.

14. A developing device having a toner tank which accommodates a toner, and conveying means which is disposed within the toner tank, agitates and conveys the toner, and conveys the toner to a developing roll through an opening portion formed in the toner tank, the developing device comprising:

support means, provided within the toner tank, for contacting the conveying means when load is applied to the conveying means by the toner;

wherein the support means partitions the toner tank in a longitudinal direction of the toner tank, so as to prevent the toner accommodated within the toner tank from being offset toward one side at a time of transport of the developing device.

15. A developing device having a toner tank which accommodates a toner, and conveying means which is disposed within the toner tank, agitates and conveys the toner, and conveys the toner to a developing roll through an opening portion formed in the toner tank, the developing device comprising:

support means, provided within the toner tank, for contacting the conveying means when load is applied to the conveying means by the toner;

wherein the conveying means is formed by a rotatable shaft disposed rotatably along a longitudinal direction of the toner tank, and a conveying member mounted to the rotatable shaft and agitating and conveying the toner, and the support means is formed by a support plate provided within the toner tank in a state of contact with the rotatable shaft and supporting the rotatable shaft when load is applied to the rotatable shaft.

16. A developing device according to claim 15, wherein a holding portion is formed at the support plate, the holding portion holding a portion of the rotatable shaft in a state of contact such that the portion of the rotatable shaft is rotatable.

17. A developing device according to claim 16, wherein the holding portion is a cut portion which is open toward the opening portion formed in the toner tank.

18. A developing device according to claim 16, wherein the holding portion is a circular hole which is formed in the support plate and through which the rotatbable shaft passes.

19. A developing device according to claim 15, wherein the support plate supports a crank portion formed at a central portion of the rotatable shaft.

20. A developing device according to claim 15, wherein an elastically-deformable fin is provided at a distal end of the conveying member.

21. A toner tank for a developing device having a developing roll, the toner tank comprising:

an elongated tank for storing a toner, the tank having an outer wall defining an opening adjacent the developing roll;

a conveyor having a shaft rotatably disposed in the tank and a conveying member connected to the shaft, rotation of the shaft resulting in the conveying member conveying the toner through the opening to the developing roll; and a support structure configured to engage and support the shaft to minimize the bending of the shaft when the shaft rotates.

22. A toner tank according to claim 21, wherein the support structure is connected to the tank and is configured to engage and support the shaft when the shaft bends a certain distance.

23. A toner tank according to claim 21, wherein the support structure is connected to the shaft to rotate with the shaft and is configured to engage the tank to support the shaft when the shaft bends a certain distance.

24. A toner tank according to claim 21, wherein the shaft is centrally disposed along a longitudinal axis of the tank and the support structure is configured to engage and support a central portion of the shaft.

25. A toner tank according to claim 21, further comprising:

a second conveyor having a shaft rotatably disposed in the tank and a conveying member connected to the tank, the rotation of the shaft agitating the toner in the tank; and a second support structure configured to engage and support the shaft of the second conveyor to minimize the bending of the shaft of the second conveyor when the shaft of the second conveyor rotates.

* * * * *